US008063897B2

(12) United States Patent
Mamba et al.

(10) Patent No.: US 8,063,897 B2
(45) Date of Patent: Nov. 22, 2011

(54) DISPLAY DEVICE

(75) Inventors: Norio Mamba, Kawasaki (JP); Toshiyuki Kumagai, Chigasaki (JP); Tsutomu Furuhashi, Yokohama (JP)

(73) Assignee: Hitachi Displays, Ltd., Chiba (JP)

( * ) Notice: Subject to any disclaimer, the term of this patent is extended or adjusted under 35 U.S.C. 154(b) by 965 days.

(21) Appl. No.: 11/838,262

(22) Filed: Aug. 14, 2007

(65) Prior Publication Data

US 2008/0062162 A1 Mar. 13, 2008

(30) Foreign Application Priority Data

Sep. 8, 2006 (JP) ..... 2006-244646

(51) Int. Cl.
*G09G 5/00* (2006.01)
*G09G 3/36* (2006.01)

(52) U.S. Cl. ..... 345/213; 345/89; 345/98

(58) Field of Classification Search ..... 345/87–104, 345/204, 213, 690
See application file for complete search history.

(56) References Cited

U.S. PATENT DOCUMENTS

| | | | | |
|---|---|---|---|---|
| 6,278,496 | B1 | 8/2001 | Kitagawa | |
| 6,466,225 | B1 | 10/2002 | Larkin | |
| 6,473,077 | B1 | 10/2002 | Takenaka et al. | |
| 6,970,148 | B2 | 11/2005 | Itoh et al. | |
| 7,280,103 | B2 * | 10/2007 | Taoka et al. | 345/204 |
| 7,777,765 | B2 * | 8/2010 | Adachi et al. | 345/690 |
| 2005/0253785 | A1 | 11/2005 | Miyasaka et al. | |
| 2006/0125812 | A1 | 6/2006 | Lee | |
| 2006/0256141 | A1 * | 11/2006 | Maruyama et al. | 345/690 |

FOREIGN PATENT DOCUMENTS

| | | |
|---|---|---|
| CN | 1815543 | 8/2006 |
| JP | 11-187285 | 7/1999 |
| JP | 2000-29442 | 1/2000 |
| JP | 2000-122596 | 4/2000 |
| JP | 2001-296841 | 10/2001 |
| JP | 2003-22061 | 1/2003 |
| JP | 2003-058141 | 2/2003 |
| JP | 2004-240317 | 8/2004 |
| JP | 2005-173387 | 6/2005 |
| JP | 2006-129105 | 5/2006 |
| JP | 2006-171749 | 6/2006 |
| WO | WO 2006/092977 | 9/2006 |

* cited by examiner

*Primary Examiner* — Jimmy H Nguyen
(74) *Attorney, Agent, or Firm* — Antonelli, Terry, Stout & Kraus, LLP.

(57) ABSTRACT

Tonal data of one frame of a video signal is subject to time division into dark subframe tonal data at a low tone and bright subframe tonal data at a high tone to compensate for a lowered luminance in the dark subframe by the bright subframe so as not to change an integrated luminance per one ordinary frame. Subframe tonal data read from a memory is converted into output tonal data constituted of dark subframe tonal data at a low tone and bright subframe tonal data at a high tone, by four arithmetic calculation operations using calculation parameters supplied from a register.

14 Claims, 8 Drawing Sheets

DISPLAY DEVICE

CLAIM OF PRIORITY

The present application claims priority from Japanese application serial no. 2006-244646 filed on Sep. 6, 2006, the content of which is hereby incorporated by reference into this application.

BACKGROUND OF THE INVENTION

The present invention relates to a hold type display device, typically a TFT liquid crystal display, and more particularly to a display device with an improved quality of moving images.

An active matrix type display device such as a TFT liquid crystal display has characteristics of a thin type, high precision and a low power consumption, and is widely used for a mobile apparatus such as a mobile phone and a portable information terminal.

High performance is progressing in mobile apparatus, particularly in mobile phones, and scenes using moving images have increased such as one segment broadcasting, reproduction of recorded moving images and applications including games. TFT liquid crystal is driven by a hold type scheme by which the same image continues to be displayed during one frame period. Therefore, as moving images are displayed, pictures are left as after images in retinas, and there occurs a phenomenon (hereinafter called "moving image blur") that the contours of displayed picturers look less clear and sharp.

U.S. Patent Publication 6473077 (JP-A-2000-122596) proposes a method of mitigating moving image blur to cancel retina after images by inserting a black display period in one frame, as a measure to prevent quality deterioration of a hold type display device. However, inserting this black display period is a pseudo impulse type driving method typically used in CRT's, and lowers the maximum luminance and contrast of displayed pictures.

U.S. Patent Unexamined Publication 20050253785 (JP-A-2005-173387) proposes a method of preventing a luminance and contrast from being lowered, by which one frame is divided into several subframes, and the luminance lowered by inserting a black display period is compensated by another subframe. Although this method is the pseudo impulse type driving method, the luminance and contrast can be prevented from being lowered as viewed in one frame period. With this method, it is necessary to generate low luminance subframe data for the pseudo impulse driving method and high luminance subframe data for the luminance compensation, from one frame data input to the system. This data conversion process uses a look-up table (hereinafter called "LUT").

In order to realize this method, a storage device of a large capacity is necessary for LUT which stores data subjected to the conversion process. If this storage is mounted on hardware such as LSI, the circuit area increases resulting in an increase in cost. It is also difficult to apply this method to mobile apparatus having strict restrictions of the circuit area.

SUMMARY OF THE INVENTION

If the pseudo impulse type driving method is adopted by the method described in U.S. Patent Unexamined Publication 20050253785 to improve the moving image blur of a hold type display device, LUT's corresponding in number to the number of tonal levels are used for time division of one frame into a plurality of subframes.

It is an object of the present invention to provide, at low cost without using LUT, a display device capable of realizing pseudo impulse type driving which is effective for improving the moving image blur without lowering a luminance and contrast.

According to the present invention, digital tonal data (hereinafter called "tonal data") of one frame is divided into two subframes. One subframe is changed to a dark luminance display subframe (hereinafter called "dark subframe") set as near to black display as possible, to be output to the display panel, and the remaining subframe is changed to bright luminance display subframe (hereinafter called "bright subframe") for compensating for a luminance lowered by the dark subframe by a high tonal data display, to be output to the display panel.

If LUT is used for all input tonal levels when dark and bright subframe tonal data is generated from the tonal data of one frame, LUT is required to have a size of "256 tonal levels×8 bits×2 subframes=4096 bits" assuming that tonal data has 256 tonal levels of 8 bits. Cost is therefore raised.

In order to reduce the cost, dark and bright subframe tonal data is calculated by digital signal processing on the basis of tonal data before time division.

By calculating tonal data of subframes by digital signal processing, LUT having a large capacity is not necessary, and only a register necessary for storing calculation parameters is used.

Tonal data for each of dark and bright subframes is calculated by four arithmetic calculation operations relative to a bending line changing a plurality of straight lines (first order functions) to thereby suppress a calculation amount. Parameters to be stored in the register are preferably coordinates and straight line gradients which change straight lines.

According to the present invention, a display device of a low cost can be realized by digital signal processing not using LUT, the display device realizing the pseudo impulse type driving for improving the moving image display performance of a hold type display device without lowering a luminance and contrast.

Other objects, features and advantages of the invention will become apparent from the following description of the embodiments of the invention taken in conjunction with the accompanying drawings.

DETAILED DESCRIPTION OF THE INVENTION

First Embodiment

Figure 1:
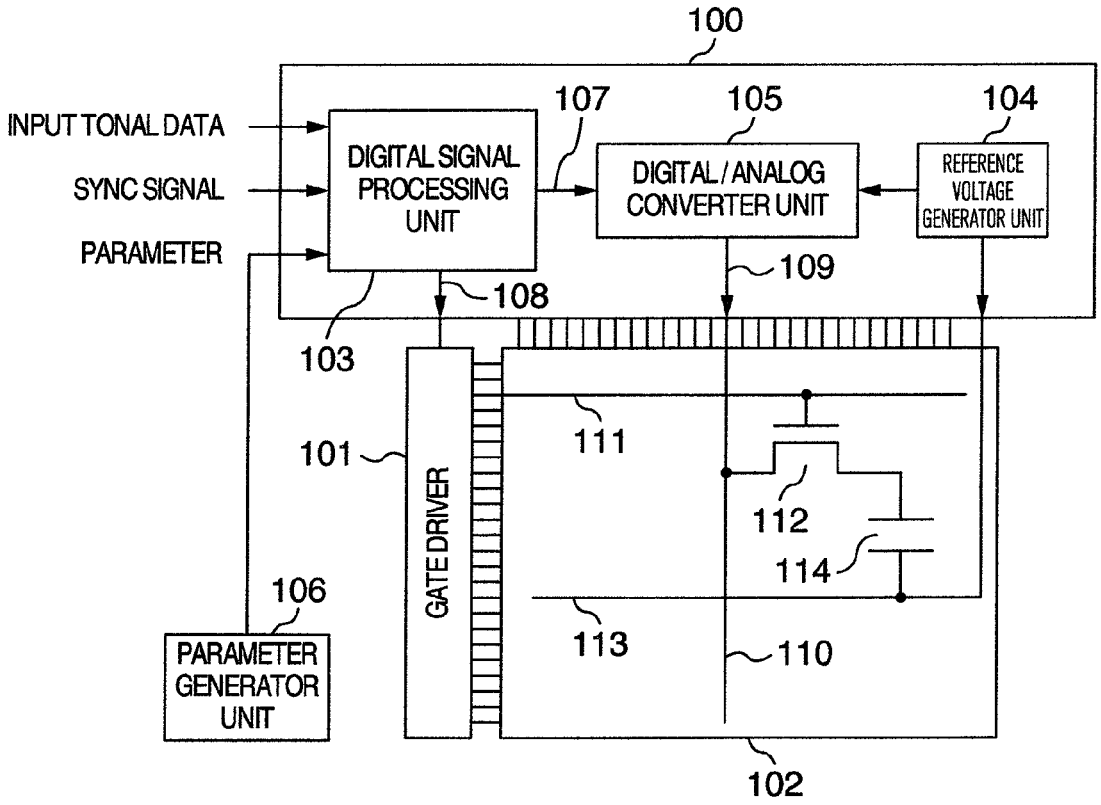
FIG. 1 is a diagram showing the structure of a liquid crystal display panel peripheral circuit of the present invention.

Description will be made on a hold type display device realizing the improvement of moving image blur according to the present invention. FIG. 1 is a diagram showing the structure of a liquid crystal display device of the present invention. Although a liquid crystal display is used as an example of the hold type display device, the present invention is applicable to other display devices of hold type driving.

The liquid crystal display device shown in FIG. 1 is constituted of a data driver 100, a gate driver 101 and a liquid crystal display panel 102. The data driver 100 has therein a digital signal processing unit 103, a reference voltage generator unit 104, and a digital/analog converter unit 105 for converting a digital signal into an analog voltage.

In FIG. 1, although the digital signal processing unit 103 is built in the data driver 100, the digital signal processing unit 103 may be included in a digital signal processing (DSP) device disposed outside the data driver 100.

The digital signal processing unit 103 generates and outputs output tonal data 107 for a dark subframe and a bright subframe and a gate driver control signal 108 for controlling the gate driver 101, by using tonal data externally input (hereinafter called "input tonal data"), sync signals (vertical sync signal: Vsync, horizontal sync signal: Hsync, and an effective period signal: DE), and parameters preset in a parameter generator unit 106 disposed outside the data driver 100.

For color video images other than monochrome data, tonal data of a plurality of color components, e.g., RGB (R: red, G: green, and B: blue), is input and required to be processed for all color components.

Output tonal data 107 output from the digital signal processing unit 103 is converted by the digital/analog converter unit 105 into an analog voltage 109 utilizing a reference voltage 109 generated by the reference voltage generator unit 104 in the digital/analog converter unit 105, and output to a data line 110 in the liquid crystal display panel 102.

In the liquid crystal display panel 102, a TFT 112 is driven by an output from the data driver 100 to the data line 110 and an output from the gate driver 101 to a gate line 111, and a transmittance of liquid crystal 114 is changed in accordance with a potential difference between the output to the data line 110 and an output from the reference voltage generator unit 104 to a common line 113, to thereby change a display luminance of the liquid crystal display panel 102.

Description will be made on the structure of the digital signal processing unit 103 of the liquid crystal display device constructed as above, the digital signal processing unit generating dark subframe tonal data and bright subframe tonal data from the input tonal data.

Figure 2:
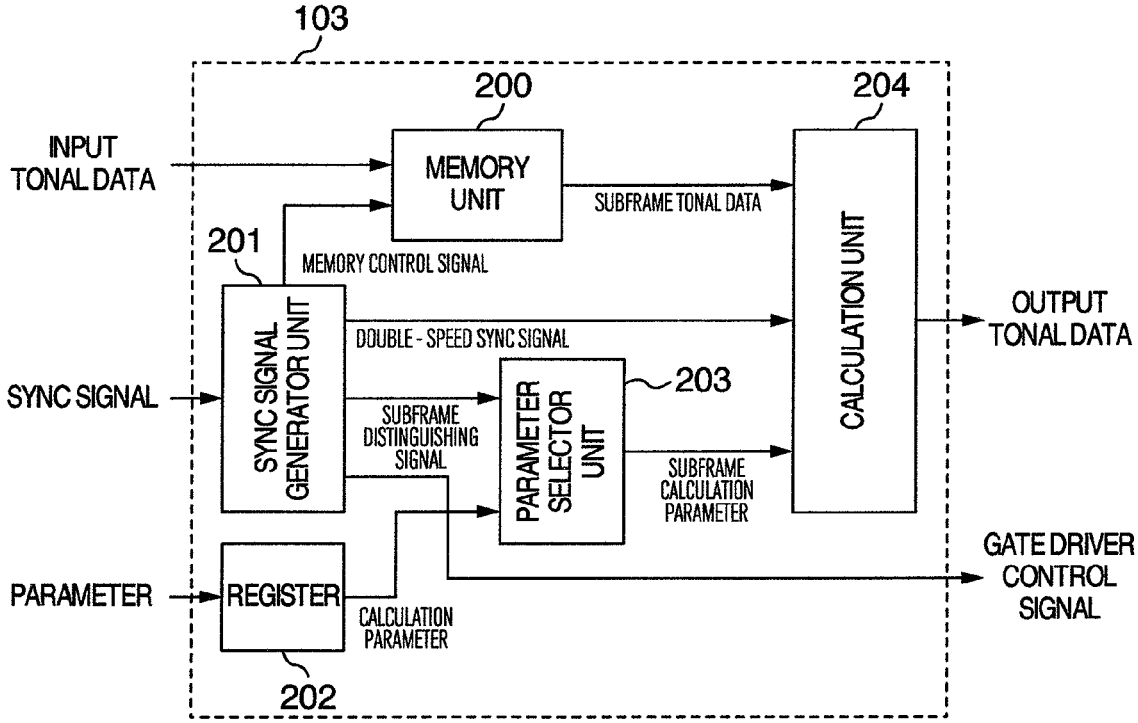
FIG. 2 is a diagram showing the structure of a digital signal processing unit of the present invention.

FIG. 2 shows the details of the digital signal processing unit 103. The digital signal processing unit 103 is constituted of: a memory unit 200 capable of storing input tonal data; a sync signal generator unit 201 for generating a control signal for the memory unit 200, a double-speed sync signal, a gate drive control signal, and a subframe distinguishing signal for distinguishing between bright and dark subframes; a register 202 for loading externally input parameters to be used for calculating dark subframe tonal data and bright subframe tonal data; a parameter selector unit 203 for selecting the calculation parameter in accordance with the subframe distinguishing signal; and a calculation unit 204 which calculates the subframe tonal data output from the memory unit 200 by using the subframe calculation parameters output from the parameter selector unit 203, including the gamma characteristics (luminance characteristics of the display panel relative to the input tonal data) of the liquid crystal display panel 102 for each subframe.

Next, with reference to the timing chart shown in FIG. 3, description will be made on the detailed operation of the digital signal processing unit 103 which generates dark subframe tonal data and bright subframe tonal data from input tonal data.

Figure 4A:
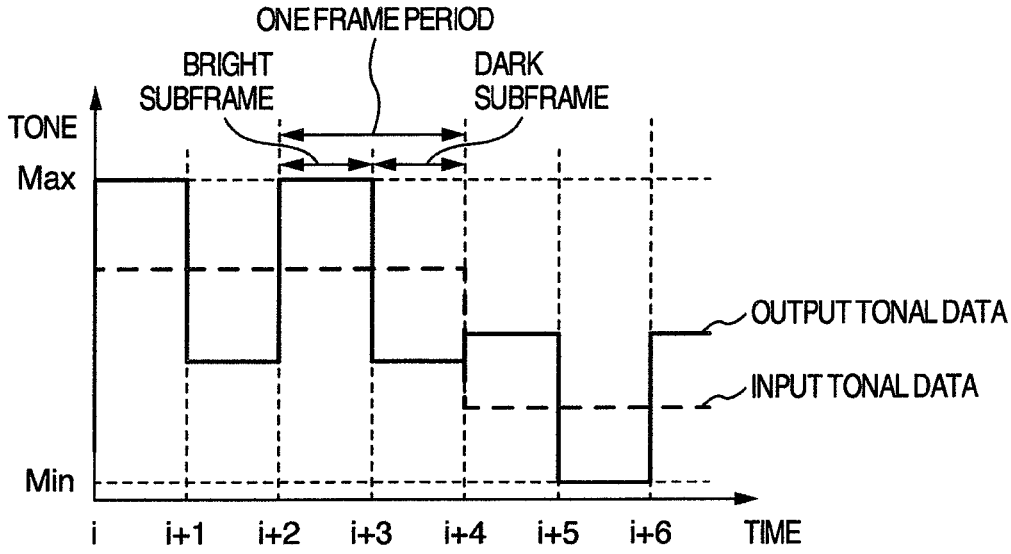
FIGS. 4A and 4B are diagrams showing the relation between tonal data and a display luminance in pseudo impulse type driving.

Paying attention to an arbitrary pixel, the input tonal data to the digital signal processing unit 103 will not change during one frame period as indicated by a bold broken line in FIG. 4A. If the digital signal processing unit 103 does not process the input tonal data, the display luminance of the hold type liquid crystal display device is almost constant during one frame period matching the input tonal data, as indicated by a broad broken line in FIG. 4B, although it takes some time for the luminance to change because of the characteristics of liquid crystal.

In contrast to this ordinary operation, the present invention realizes pseudo impulse type driving to improve the moving image blur of the hold type liquid crystal device, by making the digital signal processing unit 103 conduct time division of dividing one frame into two subframes, a dark subframe and a bright subframe.

Figure 3:
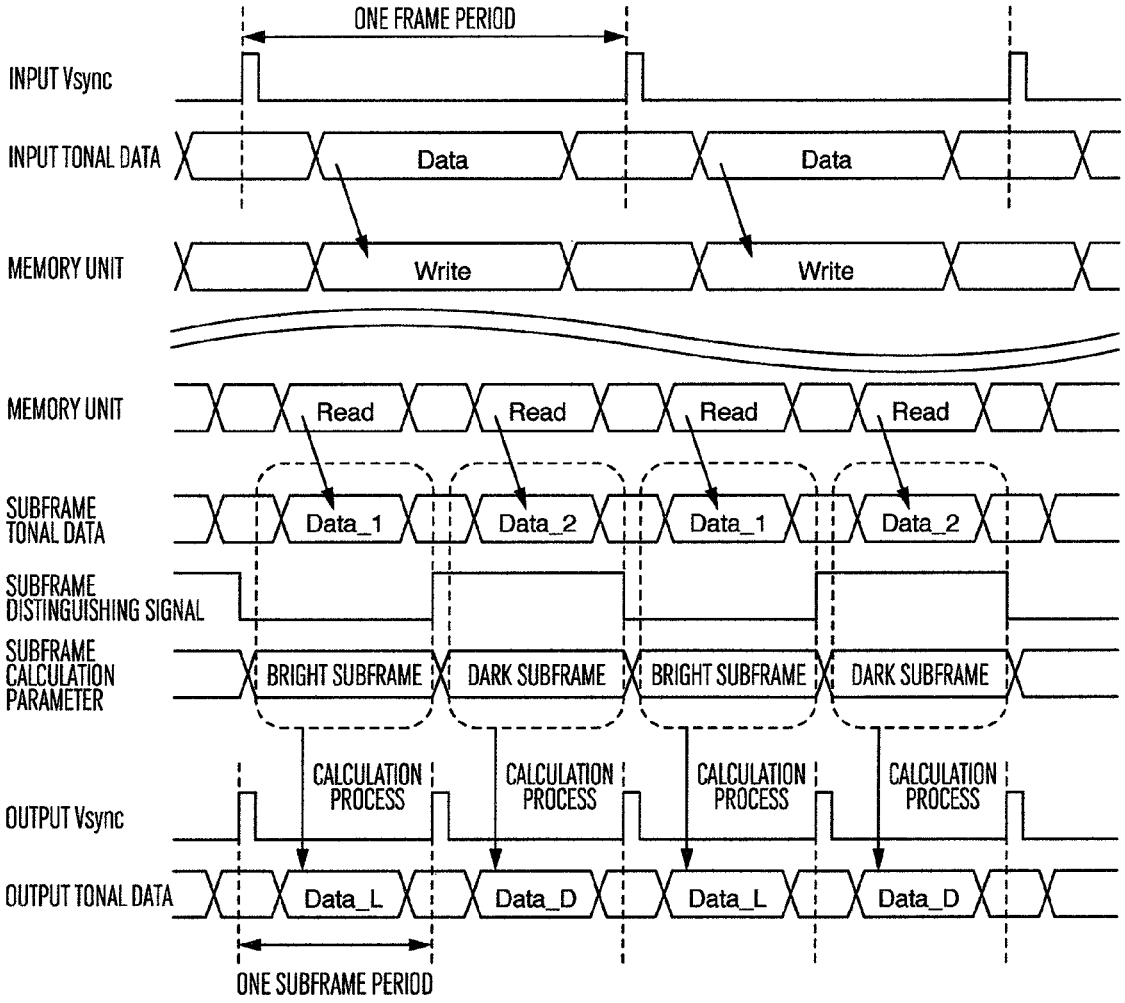
FIG. 3 is a timing chart illustrating the operation of the digital signal processing unit of the present invention.

In the following, although one frame is divided into the bright subframe and dark subframe in this order as shown in FIG. 3, there is no problem even if one frame is divided into the dark subframe and bright subframe in this order.

For time division of dividing one frame into two subframes, it is necessary to use a double-speed output sync signal, like an output Vsync for an input Vsync as shown in FIG. 3. This process is executed by the sync signal generator unit 201. The sync signal generator unit 201 also generates a memory control signal having the same period as that of the double-speed output sync signal, and tonal data such as subframe tonal data shown in FIG. 3 is read twice during one frame from the memory unit 200.

For the control method for the memory unit 200, a memory unit 200 may be prepared which can store tonal data of, e.g., two frames or more, and a read/write bank is switched for each frame.

The subframe tonal data read in this manner is sent to the calculation unit 204, together with the calculation parameters for the dark or bright subframe selected by the parameter selector unit 203 in accordance with the subframe distinguishing signal for distinguishing between two subframes, generated by the sync signal generator unit 201.

By using the subframe tonal data read from the memory unit 200 at a double-speed and the subframe calculation parameters to be used for each subframe, the calculation unit 204 calculates the dark subframe tonal data and bright subframe tonal data, and outputs the tonal data from the digital signal processing unit 103. In this case, for the input tonal data indicated by the bold broken line in FIG. 4A, tonal data transited to the low tonal side is generated in the dark subframe and tonal data transited to a high tonal side is generated in the bright subframe, as indicated by a bold solid line in FIG. 4A.

Figure 4B:
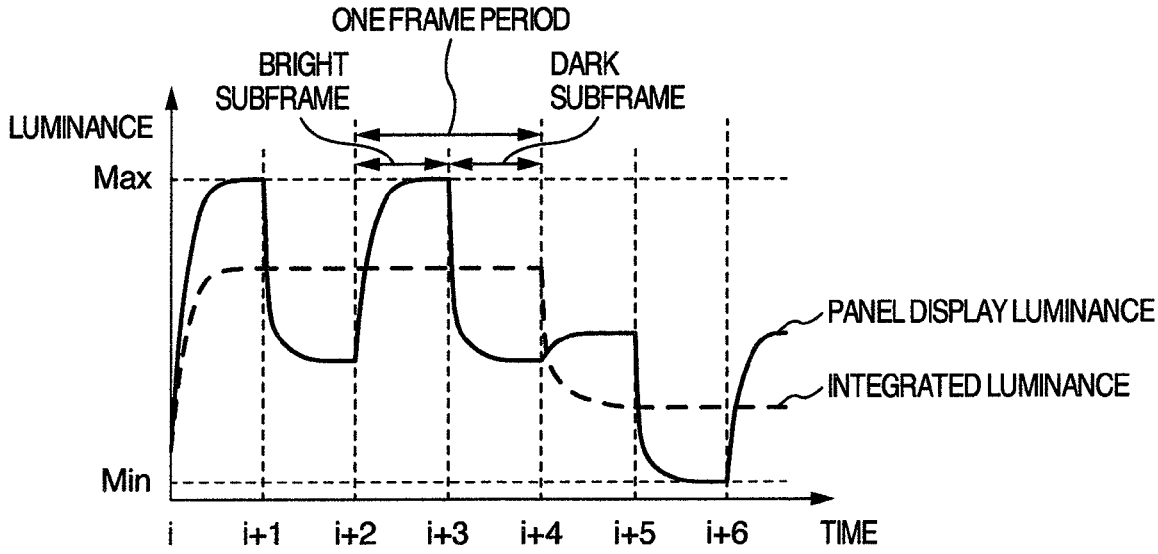

Therefore, the display luminance of the liquid crystal panel 102 changes as indicated by a bold solid line in FIG. 4B. However, human eyes recognize the luminance change indicated by the bold broken line in FIG. 4B because of recognition by the human eyes of a luminance integrated by a constant time.

Therefore, the tonal data to be output from the digital signal processing unit 103 is controlled in such a manner that an average of luminances of the dark and bright subframes indicated by the broad solid line in FIG. 4B is controlled to take the luminance indicated by the bold broken line in FIG. 4B. Therefore, the luminance and contrast will not change between a direct output of input tonal data of one frame and a time division output of one frame into the dark and bright subframes. However, in the case of time division, the moving image blur is improved.

In this case, if the output tonal data of the dark subframe is made as near to black (0 tone) as possible, the cancellation effect of retina after images becomes high and the improvement effect of moving image blur becomes high. This cannot be applied to the case in which the luminance lowers because of a slow liquid crystal response in the subframe period or flickers are formed in a display image, resulting from a large difference between the liquid crystal response times from low tone to high tone and from high tone to low tone.

Figure 5A:
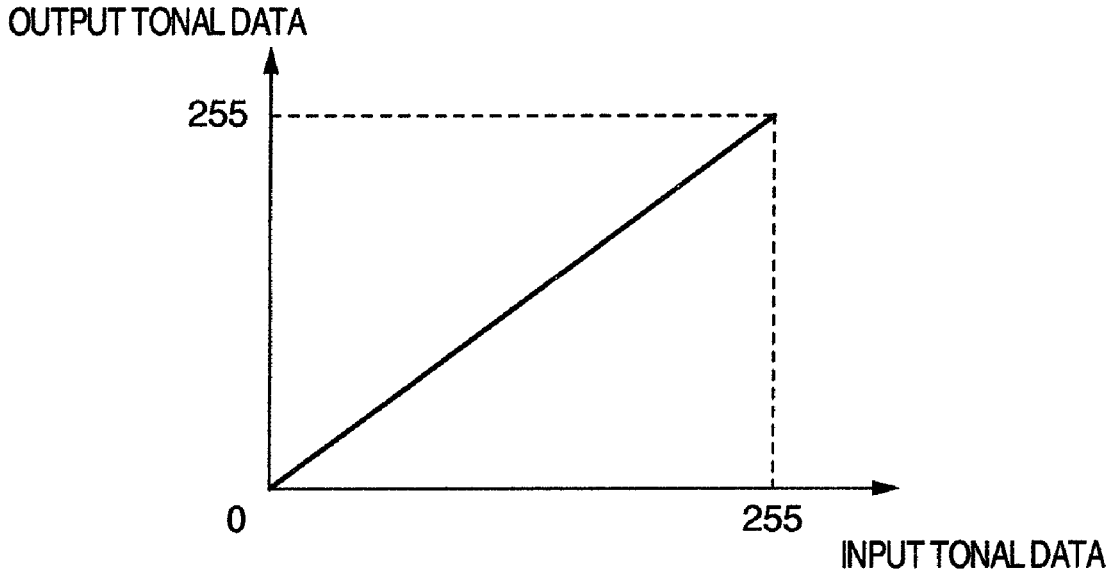
FIGS. 5A and 5B are diagrams showing the relation between input tonal data, and output tonal data and gamma characteristics in usual one frame driving.
Figure 5B:
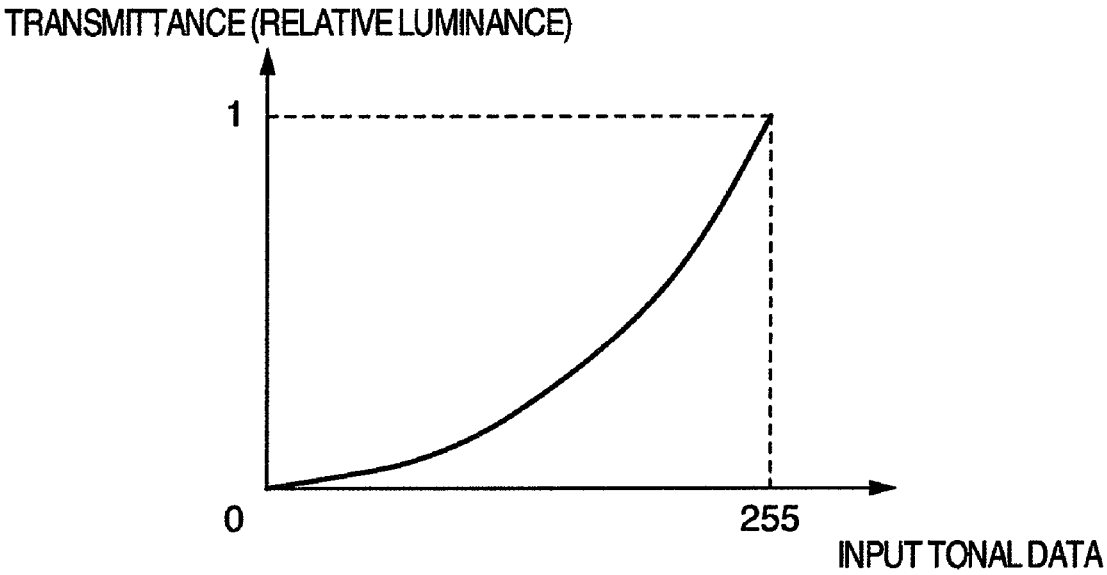

Detailed description will be made herein on a calculation method by the calculation unit 204 of the embodiment. The following description will be made on the assumption that in the ordinary one frame driving, the input/output tonal data is 8 bits (maximum tonal data=255) as shown in FIG. 5A, and the display panel 102 has a gamma of $\gamma=2.2$ satisfying the following formula (1) and providing the transmittance shown in FIG. 5B when the input tonal data is equal to the output tonal data. These values may be changed as desired. Namely, the input/output tonal data characteristics shown in FIG. 5A in the ordinary one frame driving can obtain the transmittance (relative luminance) shown in FIG. 5B.

$$[(\text{input tonal data})/(\text{maximum tonal data})]^{2.2}=\text{relative luminance (liquid crystal transmittance)} \quad (1)$$

Figure 6A:
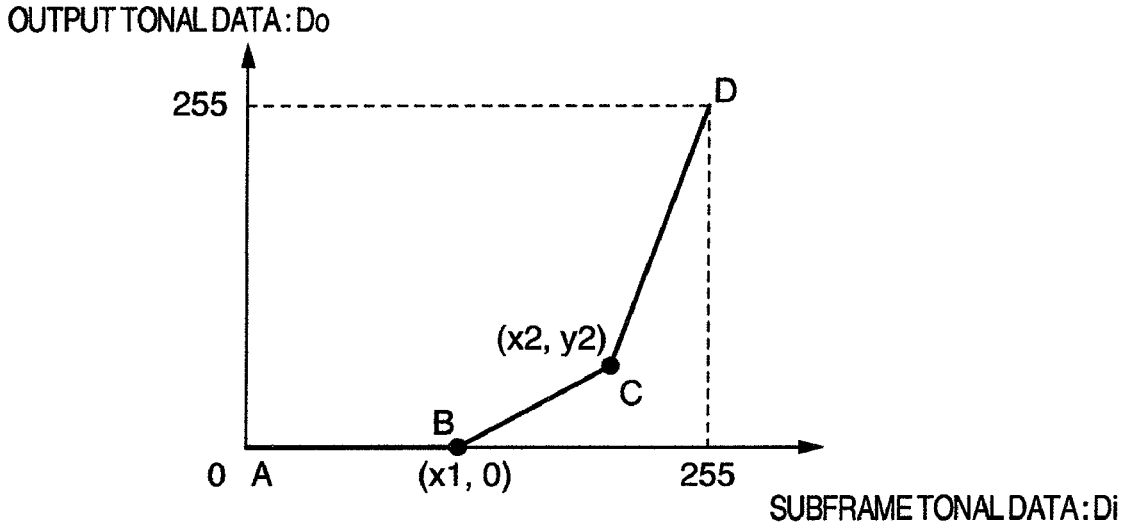
FIGS. 6A and 6B are diagrams illustrating digital signal processing according to a first embodiment of the present invention.

First, on the dark subframe side in double-speed driving, the subframe tonal data input to the calculation unit 204 is changed to lowered output tonal data to thereby lower the luminance. In this case, as shown in FIG. 6A, the output tonal data is calculated by using three straight lines AB, BC and CD. By representing the subframe tonal data in FIG. 6A as Di, output tonal data as Do, coordinates at a point B as (x1, 0), and coordinates at a point C as (x2, y2), the straight lines AB, BC and CD can be defined by the following formulas (2), (3) and (4).

$$\text{If } 0 \leqq Di \leqq x1, \text{ then } Do=0 \quad (2)$$

$$\text{If } x1<Di \leqq x2, \text{ then } Do=[y2/(x2-x1)]\times(Di-x1) \quad (3)$$

$$\text{If } x2<Di \leqq 255, \text{ then } Do=[(255-y2)/(255-x2)]\times(Di-x2)+y2 \quad (4)$$

It is however preferable to control in such a manner that Do=0 if D0<0 and Do=255 if D0>255, because Do is in the range of $0 \leqq Do \leqq 255$.

As shown in FIG. 6A, output tonal data of subframe tonal data can be changed to the low tonal side by using the formulas (2), (3) and (4).

Figure 6B:
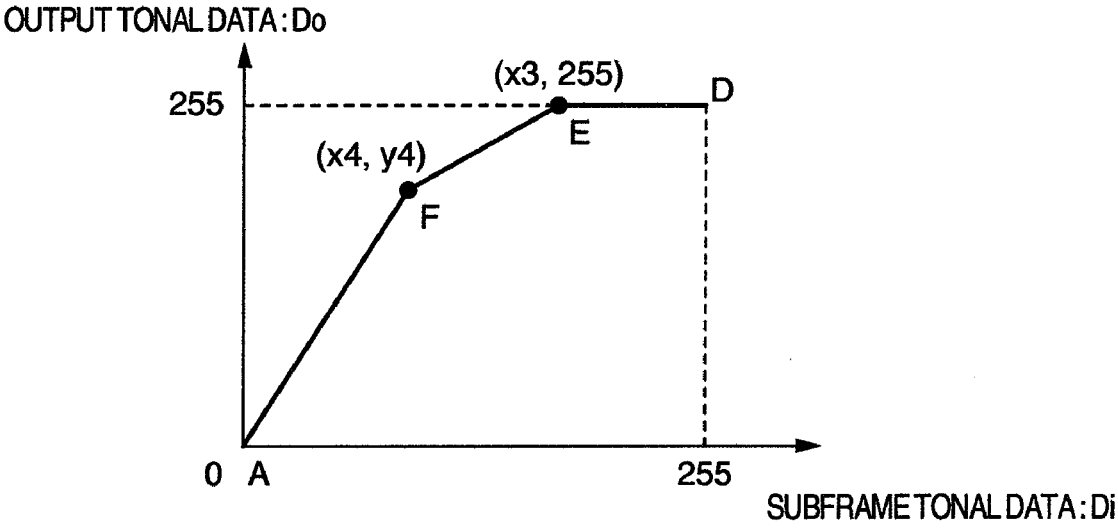

On the bright subframe side, the output tonal data of the subframe tonal data is made large to raise the luminance. In this case, the output tonal data is calculated by using three straight lines DE, EF and FA as shown in FIG. 6B. By representing the subframe tonal data in FIG. 6B as Di, output tonal data as Do, coordinates at a point E as (x3, 255), and coordinates at a point F as (x4, y4), the straight lines DE, EF and FA can be defined by the following formulas (5), (6) and (7).

$$\text{If } x3<Di \leqq 255, \text{ then } Do=255 \quad (5)$$

$$\text{If } x4<Di \leqq x3, \text{ then } Do=[(255-y4)/(x3-x4)]\times(Di-x4)+y4 \quad (6)$$

$$\text{If } 0 \leqq Di \leqq x4, \text{ then } Do=[y4/x4]\times Di \quad (7)$$

It is however preferable to control in such a manner that Do=0 if D0<0 and Do=255 if D0>255, because Do is in the range of $0 \leqq Do \leqq 255$. It is necessary that the output tonal data is generated so as to always satisfy the relation that "dark subframe tonal data≦bright subframe tonal data". If the dark subframe tonal data and the bright subframe tonal data are equal, the tonal data takes the minimum and maximum values at points A and D shown in FIG. 6A.

By using the formulas (5), (6) and (7), it becomes possible in this way that the output tonal data of subframe tonal data can be changed to the high tonal side as shown in FIG. 6B.

Figure 7A:
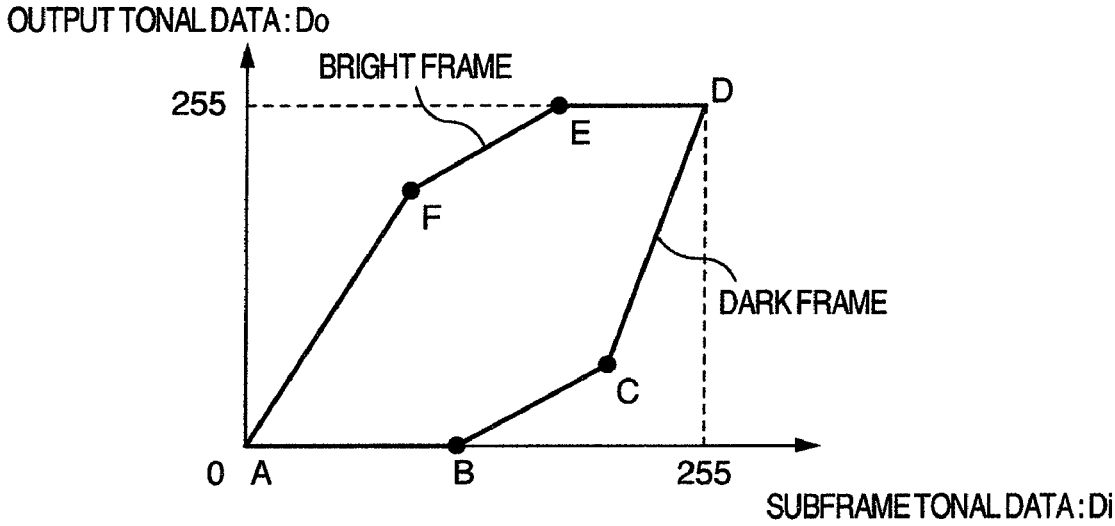
FIGS. 7A and 7B are diagrams showing the relation between input tonal data, and output tonal data and gamma characteristics in pseudo impulse type driving.

As described above, if the output tonal data is calculated by the formulas (2) to (7), output tonal data of the dark subframe and bright subframe can be generated by using only six parameters of x1, x2, x3, x4, y2 and y4 as shown in FIG. 7A, so that the capacity of the register 202 can be suppressed.

In this case, the improvement effect of moving image blur to be caused by inserting a black period can be expected to be increased further by adjusting each parameter in such a manner that point B in FIG. 6A is moved toward the right direction (high tonal side) as much as possible to make large a difference between dark subframe tonal data and bright subframe tonal data.

However, if flickers are generated on a display image caused by a low liquid crystal response speed, it is desired that each parameter is adjudged so as to move point B to the left (low tonal side) and make small a difference between dark subframe tonal data and bright subframe tonal data.

The parameter can be adjusted by the parameter generator unit 106 shown in FIG. 1. The parameter is adjusted in or outside the display device in accordance with the characteristics of the display panel, an ambient temperature, a display image and the like.

Figure 7B:
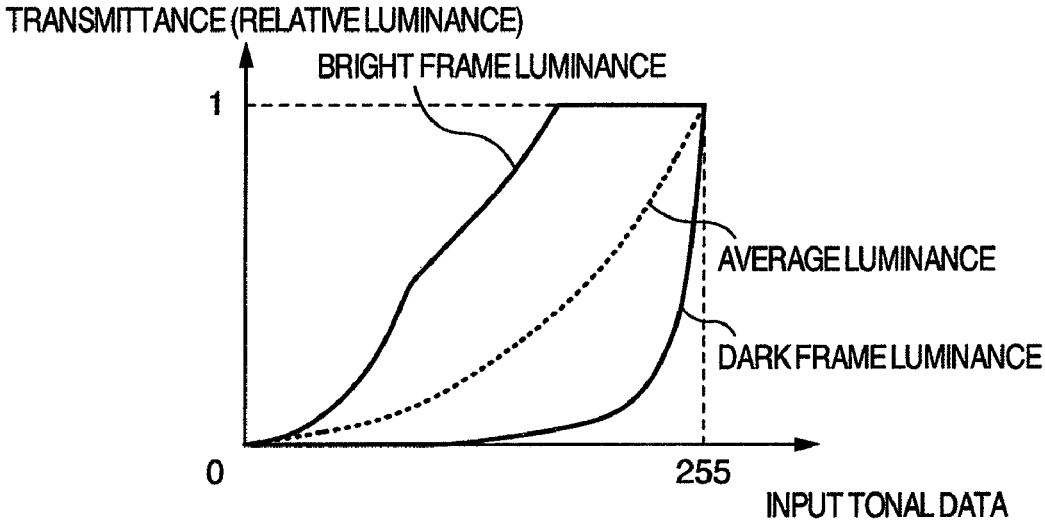

If the above-described six parameters are set in such a manner that an average luminance (a bold broken line in FIG. 7B) between the dark subframe luminance and bright subframe luminance indicated by a solid line in FIG. 7B is set to obtain an assumed display panel gamma of $\gamma=2.2$, the luminance and hue of the liquid crystal display do not change between a direct output of input tonal data (FIG. 5B) and an output by pseudo impulse type driving (FIG. 7B).

As described above, the embodiment can realize a display device at low cost without using LUT and capable of improving moving image blur without lowering the luminance and contrast.

Second Embodiment

The liquid crystal display of the second embodiment has the structure shown in FIG. 1 similar to the first embodiment. Although the liquid crystal display of the second embodiment has the digital signal processing unit 103 of the structure shown in FIG. 2 similar to the first embodiment, parameters loaded in the register 202 and the calculation method by the calculation unit 204 are different from those of the first embodiment.

Figure 8A:
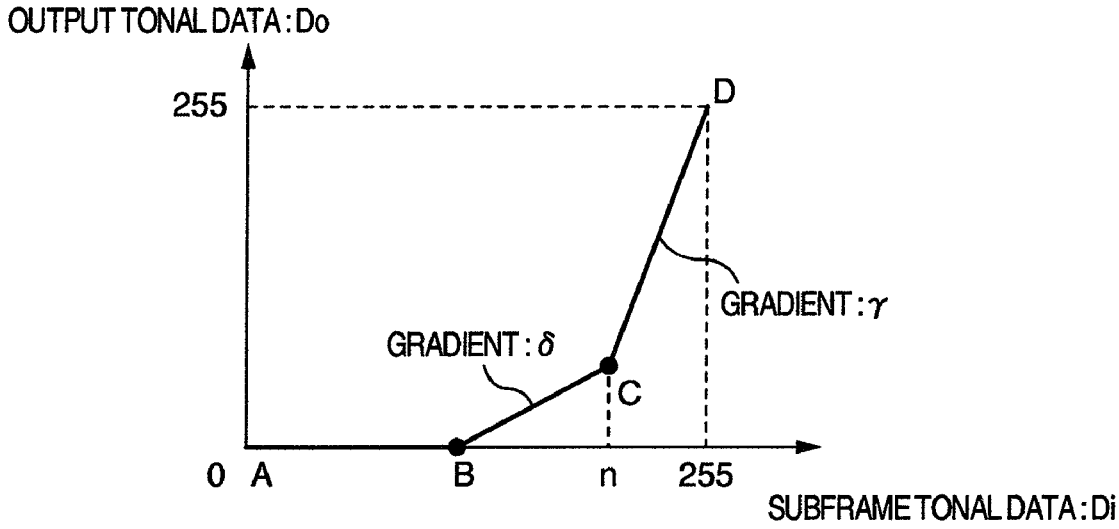
FIGS. 8A and 8B are diagrams showing illustrating digital signal processing according to a second embodiment of the present invention.

First, on the dark subframe side, the output tonal data of the subframe tonal data is made small to lower the luminance. In this case, as shown in FIG. 8A the output tonal data is calculated by using three straight lines AB, BC and CD. In the first embodiment, the coordinates of points B and C are set as parameters. Since the calculation formulas contain a division process using variables, a circuit area of the digital signal processing circuit 103 increases because the calculation formulas are realized by hardware.

In this embodiment, in order to reduce the circuit area by removing the division process using variables, gradients of the straight lines BC and CD and the coordinates of point C are set as parameters. By representing the subframe tonal data shown in FIG. 8A as Di, output tonal data as Do, a gradient of the straight line CD as γ, a gradient of the straight line BC as δ, and a coordinate at point C as n, the calculation formulas for the straight lines BC and CD can be defined by the following formulas (8) and (9). The calculation formula for the straight line AB is defined by setting "Do=0" when the calculation result of the straight line BC by the formula (8) becomes 0 or smaller.

$$Do=255-\{\delta\times(n-Di)+\gamma\times(255-n)\} \quad (8)$$

$$Do=255-\gamma\times(255-Di) \quad (9)$$

In actual calculations, the formula (8) is selectively used for Di<n and the formula (9) is selectively used for Di≧n. Further, it is desired to control in such a manner that Do=0 for Do<0 and Do=255 for Do>255, because Do is in the range of 0≦Do≦255.

By using the formulas (8) and (9), it is possible to change the output tonal data of the subframe tonal data to the low tonal side as shown in FIG. 8A.

Figure 8B:
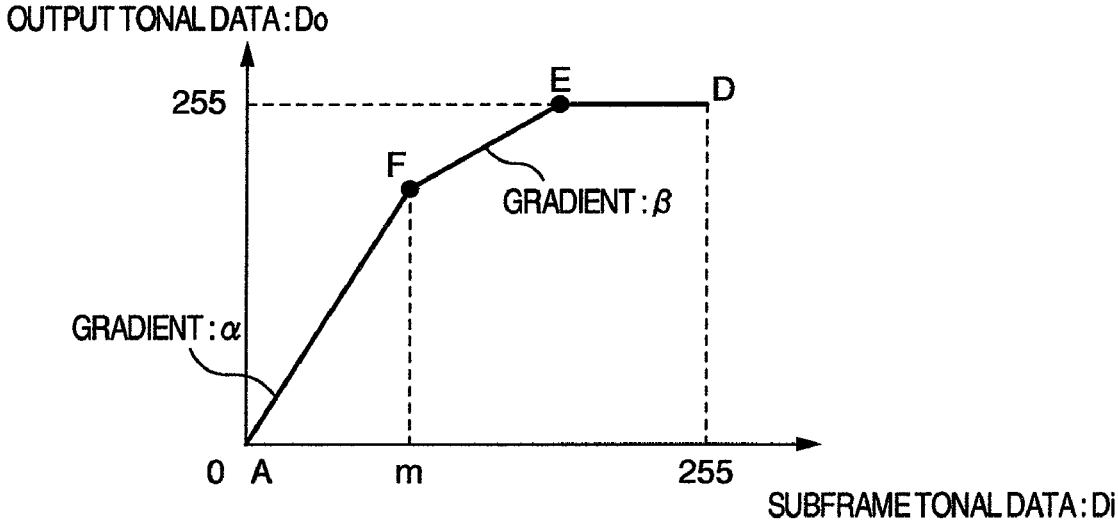

Next, on the bright subframe side, the output tonal data of the subframe tonal data is made large to increase the luminance. In this case, similar to the dark subframe side, gradients of straight lines EF and FA and a coordinate at point F are set as parameters as shown in FIG. 8B. By representing the subframe tonal data shown in FIG. 8B as Di, output tonal data as Do, a gradient of the straight line FA as α, a gradient of the straight line EF as β, and a coordinate at point F as m, the calculation formulas for the straight lines EF and FA can be defined by the following formulas (10) and (11). The calculation formula for the straight line DE is defined by setting "Do=255" when the calculation result of the straight line EF by the formula (10) becomes 255 or larger.

$$Do=\beta\times(Di-m)+\alpha\times m \quad (10)$$

$$Do=\alpha\times Di \quad (11)$$

In actual calculations, the formula (10) is selectively used for Di<m and the formula (11) is selectively used for Di≧m. Further, it is desired to control in such a manner that Do=0 for Do<0 and Do=255 for Do>255, because Do is in the range of 0≦Do≦255. Further, it is necessary to always generate the output tonal data so as to satisfy the relation of "dark subframe tonal data≦bright subframe tonal data".

By using the formulas (10) and (11), it is possible to change the output tonal data of the subframe tonal data to the high tonal side as shown in FIG. 8B.

As described above, the output tonal data of the dark and bright subframes can be generated by calculations of the formulas (8) to (11) using six parameters including the gradient γ of the straight line CD, the gradient δ of the straight line BC, the coordinate n of point C, the gradient α of the straight line FA, the gradient β of the straight line EF and the coordinate m of point F. Moreover, since the division process of variables in the calculation formulas is not used, a circuit area of the digital signal processing unit 103 can be reduced more than the first embodiment.

Of the six parameters, four parameters including the gradient γ of the straight line CD, the gradient δ of the straight line BC, the gradient α of the straight line FA, and the gradient β of the straight line EF may take a decimal value. However, if these gradients are approximated to $I/2^J$ (I and J are an integer), the circuit area can further be reduced.

In this case, the improvement effect of moving image blur to be caused by inserting a black period can be expected to be increased further by adjusting each parameter in such a manner that point B in FIG. 8A is moved toward the right direction (high tonal side) as much as possible to make large a difference between dark subframe tonal data and bright subframe tonal data. However, if flickers are generated on a display image caused by a low liquid crystal response speed, it is desired that each parameter is adjudged so as to move point B to the left (low tonal side) and make small a difference between dark subframe tonal data and bright subframe tonal data. The parameter can be adjusted by the parameter generator unit 106 shown in FIG. 1.

If the above-described six parameters are set in such a manner that an average luminance (the bold broken line in FIG. 7B) between the dark subframe luminance and bright subframe luminance indicated by the solid line in FIG. 7B is set to obtain a gamma of γ=2.2, the luminance and hue of the liquid crystal display do not change between a direct output of input tonal data (FIG. 5B) and an output by pseudo impulse type driving (FIG. 8B).

As described above, the second embodiment can realize a display device capable of improving moving image blur without lowering the luminance and contrast, at lower cost for the digital signal processing unit 103 than the first embodiment.

Third Embodiment

The liquid crystal display of the third embodiment has the structure shown in FIG. 1 similar to the first and second embodiments. Although the liquid crystal display of the third embodiment has the digital signal processing unit 103 of the structure shown in FIG. 2 similar to the first and second embodiments, parameters loaded in the register 202 and the calculation method by the calculation unit 204 are different from those of the first and second embodiments.

Figure 9A:
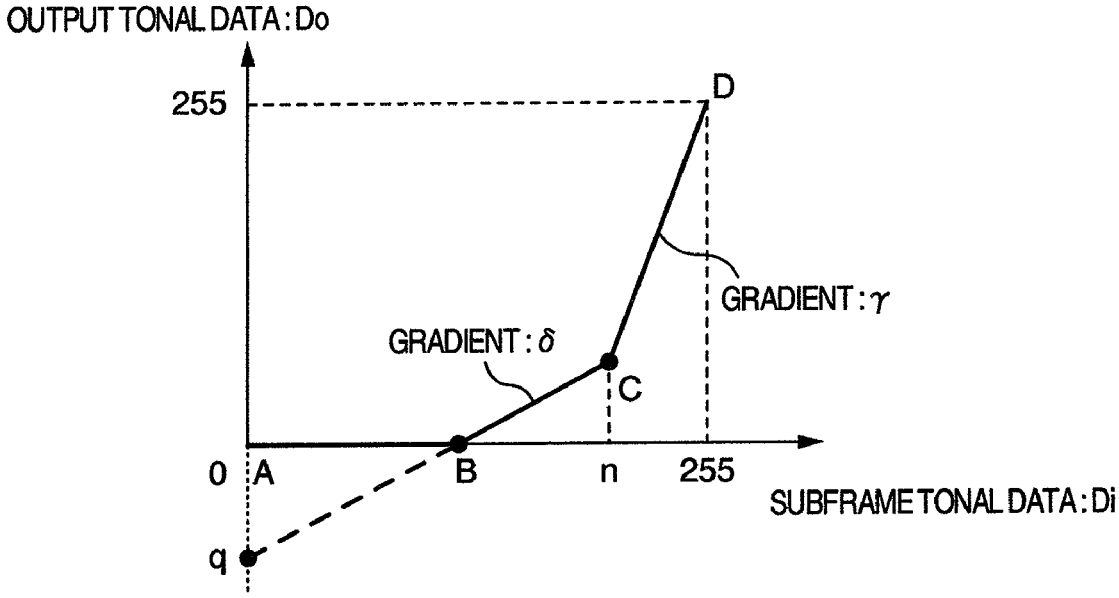
FIGS. 9A and 9B are diagrams showing illustrating digital signal processing according to a third embodiment of the present invention.

First, on the dark subframe side, the output tonal data of the subframe tonal data is made small to lower the luminance. In this case, as shown in FIG. 9A the output tonal data is calculated by using three straight lines AB, BC and CD. In the second embodiment, each of the calculation formulas (8) and (10) for the straight lines BC and EF contain two multiplication processes. This results in an increase in a circuit area because the calculation formulas are realized by hardware.

As compared to a division circuit, the multiplication circuit has a smaller circuit area, however as compared to an addition circuit, the multiplication circuit has a larger circuit area. In order to reduce the number of multiplication processes and the circuit area, the third embodiment sets, as parameters, gradients of the straight lines BC and CD, a coordinate of point C, an intercept of the straight line BC in FIG. 9A with an output tonal data axis (hereinafter called "Y-axis). By representing the subframe tonal data shown in FIG. 9A as Di, output tonal data as Do, a gradient of the straight line CD as γ, a gradient of the straight line BC as δ, and a Y-axis intercept of the straight line BC as q, the calculation formulas for the straight lines BC and CD can be defined by the following formulas (12) and (13). The calculation formula for the straight line AB is defined by setting "Do=0" when the calculation result of the straight line BC by the formula (12) becomes 0 or smaller. q takes a negative value.

$$Do=\delta\times Di+q \quad (12)$$

$$Do=255-\gamma\times(255-Di) \quad (13)$$

In actual calculations, depending upon the coordinate n in FIG. 9A, the formula (12) is selectively used for Di<n and the formula (13) is selectively used for Di≧n. Further, it is desired to control in such a manner that Do=0 for Do<0 and Do=255 for Do>255, because Do is in the range of 0≦Do≦255.

By using the formulas (12) and (13), it is possible to change the output tonal data of the subframe tonal data to the low tonal side as shown in FIG. 9A.

Figure 9B:
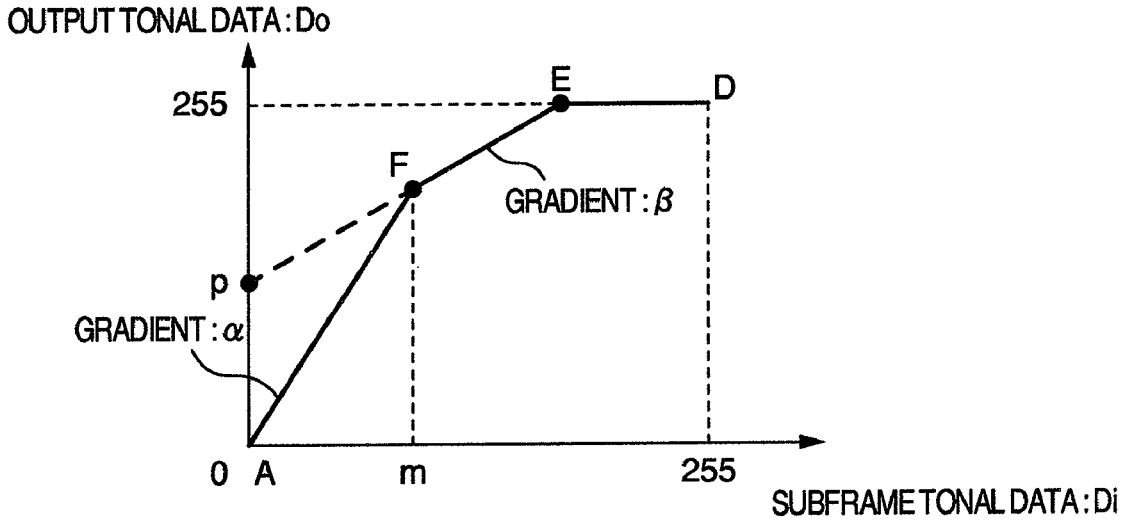

Next, on the bright subframe side, the output tonal data of the subframe tonal data is made large to increase the luminance. In this case, similar to the dark subframe side, gradients of straight lines EF and FA, a coordinate at point F and the Y-axis intercept of the straight line EF are set as calculation parameters as shown in FIG. 9B. By representing the subframe tonal data shown in FIG. 9B as Di, output tonal data as Do, a gradient of the straight line FA as α, a gradient of the straight line EF as β, and a Y-axis intercept of the straight line EF as p, the calculation formulas for the straight lines EF and FA can be defined by the following formulas (14) and (15). The calculation formula for the straight line DE is defined by setting "Do=255" when the calculation result of the straight line EF becomes 255 or larger.

$$Do=\beta\times Di+p \quad (14)$$

$$Do=\alpha\times Di \quad (15)$$

In actual calculations, depending upon the coordinate m at point F, the formula (14) is selectively used for Di>m and the formula (15) is selectively used for Di≦m. Further, it is desired to control in such a manner that Do=0 for Do<0 and Do=255 for Do>255, because Do is in the range of 0≦Do≦255.

By using the formulas (14) and (15), it is possible to change the output tonal data of the subframe tonal data to the high tonal side as shown in FIG. 9B. It is necessary however to always generate the output tonal data so as to satisfy the relation of "dark subframe tonal data≦bright subframe tonal data".

As described above, the output tonal data of the subframe tonal data of the dark and bright subframes can be generated by calculations of the formulas (12) to (15) using eight parameters including the gradient γ of the straight line CD, the gradient δ of the straight line BC, the coordinate n of point C, the Y-axis intercept q of the straight line BC, the gradient α of the straight line FA, the gradient β of the straight line EF, the coordinate m of point F, and the Y-axis intercept p of the straight line EF. Moreover, since only one multiplication process is used in the calculation formula, a circuit area of the digital signal processing unit 103 can be reduced more than the second embodiment, although a capacity of the resister 202 increases slightly. It is however necessary to calculate beforehand the parameter q in the formula (12) and the parameter p in the formula (14) in the parameter generator unit 106 by using the following formulas (16) and (17).

$$q=255-\{\delta\times n+\gamma\times(255-n)\} \quad (16)$$

$$p=m\times(\alpha-\beta) \quad (17)$$

Of the eight parameters, four parameters including the gradient γ of the straight line CD, the gradient δ of the straight line BC, the gradient α of the straight line FA, and the gradient β of the straight line EF may take a decimal value. However, if these gradients are approximated to $I/2^J$ (I and J are an integer), the circuit area can further be reduced.

In this case, the improvement effect of moving image blur to be caused by inserting a black period can be expected to be increased further by adjusting each parameter in such a manner that point B in FIG. 9A is moved toward the right direction (high tonal side) as much as possible to make large a difference between dark subframe tonal data and bright subframe tonal data. However, if flickers are generated on a display image caused by a low liquid crystal response speed, it is desired that each parameter is adjudged so as to move point B to the left (low tonal side) and make small a difference between dark subframe tonal data and bright subframe tonal data. The parameter can be adjusted by the parameter generator unit 106 shown in FIG. 1.

If the above-described eight parameters are set in such a manner that an average luminance (the bold broken line in FIG. 7B) between the dark subframe luminance and bright subframe luminance indicated by the solid line in FIG. 7B is set to obtain gamma of γ=2.2, the luminance and hue of the liquid crystal display do not change between a direct output of input tonal data (FIG. 5B) and an output by pseudo impulse type driving (FIG. 9B).

As described above, the third embodiment can realize a display device capable of improving moving image blur without lowering the luminance and contrast, at lower cost for the digital signal processing unit 103 than the second embodiment. However, since the capacity of the register 202 increases, it is desired to selectively use the second embodiment if a limit of the capacity of the register 202 is severe, and selectively use the third embodiment if a limit of the circuit area of the digital signal processing unit 103 is severe.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device configured to convert input tonal data into a plurality of tonal data, and configured to display said plurality of tonal data during a period while an input tonal data of a one frame is displayed, and having a signal processing circuit configured to process at double speed, through time division of the one frame into a first subframe and a second subframe, said signal processing circuit comprising:

a memory configured to store input tonal data of a frame period, said stored input tonal data being read during the first and the second subframe periods;

a calculation circuit configured to conduct a calculation, using parameters and subframe tonal data read from said memory, and configured to output a calculated result;

a register configured to store a plurality of parameters generated by a parameter generator circuit, and configured to output the parameters;

a selector circuit configured to select a parameter among a plurality of parameters output from the register, and configured to output the selected parameter to said calculation circuit; and a sync signal generator circuit configured to be responsive to an input sync signal, configured to output a memory control signal to said memory, configured to output a double-speed sync signal to said calculation circuit, and configured to output a subframe distinguishing signal to said selector circuit;

wherein said plurality of tonal data include high tonal data having a higher tone than said input tonal data, and include low tonal data having a lower tone than said input tonal data;

wherein in a graph representing output tonal data along a vertical axis and the input tonal data along a horizontal axis, characteristics of said high tonal data are such that the output tonal data has a plurality of bending points and is higher than the input tonal data, and characteristics of said low tonal data are such that the output tonal data has another plurality of bending points and is lower than the input tonal data;

wherein a calculation by said calculation circuit uses sets of formulas to make a luminance of output tonal data high during the first subframe period and low during the second subframe period; and wherein each set of formulas represents a broken line shape including a plurality of bending points.

2. The display device according to claim 1, wherein an integrated luminance and gamma characteristics during a one frame period when a time division into the first and second subframes is executed, are same as an integrated luminance and gamma characteristics during a one frame period when a time division into the first and second subframes is not executed.

3. The display device according to claim 1, wherein said parameter is set in such a manner that a luminance of output tonal data during the second subframe period becomes as low.

4. The display device according to claim 1, wherein coordinates of a point at which a gradient of straight lines change are used as a parameter, and a formula for a straight line is determined from a set of the coordinates, to thereby calculate output tonal data for the first and second subframes.

5. The display device according to claim 1, wherein coordinates of a point at which a gradient of straight lines change and a gradient of a straight line are used as parameters, and a formula for a straight line is determined from a set of the coordinates and the gradient of a straight line, to thereby calculate output tonal data for the first and second subframes.

6. The display device according to claim 1, wherein coordinates of a point at which a gradient of straight lines change, a gradient of a straight line and a Y-axis intercept coordinate are used as parameters, and a formula for a straight line is determined from a set of the coordinates and the gradient of a straight line, to thereby calculate output tonal data for the first and second subframes.

7. The display device according to claim 1, wherein:

said input tonal data is either monochrome data or color data containing a plurality of color components;

for the color data, said calculation circuit generates output tonal data during the first and second subframe periods for each of the color components.

8. The display device according to claim 1, further comprising a register capable of setting parameters defining said plurality of bending points of the characteristics of said high tonal data and parameters defining said another plurality of flame bending points of the characteristics of said low tonal data, utilizing a command from an external device.

9. The display device according to claim 1, further comprising:

a display panel;

a processing circuit configured to convert said input tonal data into said plurality of tonal data;

a first driver configured to apply tonal voltages corresponding to said plurality of tonal data to pixels of said display panel; and a second driver configured to scan the pixels of said display panel to be applied with said tonal voltages.

10. A display device configured to convert a one frame period of an input tonal data into a corresponding time period of a plurality of output tonal data, and configured to display said plurality of output tonal data during the one frame period of said input tonal data, said display device comprising:

a signal processing circuit configured to process at double speed, through time division of a one frame of input tonal data into a first sub-frame and a second sub-frame of output tonal data, said signal processing circuit including:

a memory configured to store a one frame period of input tonal data;

a calculation circuit configured to conduct a calculation on said stored input tonal data read from the memory, by using parameters and sub-frame tonal data read from said memory, and configured to output a calculated result of output tonal data, wherein a calculation by said calculation circuit uses sets of formulas to make a luminance of output tonal data high during the first sub-frame period, and low during the second sub-frame period, wherein each set of formulas represents a broken line shape including a plurality of bending points, wherein said output tonal data includes high tonal data having a higher tone than said input tonal data, and low tonal data having a lower tone than said input tonal data, and wherein in a graph representing output tonal data along a vertical axis and the input tonal data along a horizontal axis, characteristics of said high tonal data are such that the output tonal data has a plurality of bending points and is higher than the input tonal data, and characteristics of said low tonal data are such that the output tonal data has another set of a plurality of bending points and is lower than the input tonal data;

a register configured to store a parameter generated by a parameter generator circuit, and configured to output the parameters;

a selector circuit configured to select a parameter among a plurality of parameters output from the register, and configured to output the selected parameter to said calculation circuit; and a sync signal generator circuit responsive to an input sync signal, and configured to output a memory control signal to said memory, output a double-speed sync signal to said calculation circuit, and output a subframe distinguishing signal to said selector circuit.

11. The display device according to claim 10, wherein whenever a time division into the first and second sub-frames is executed, an integrated luminance is the same as an integrated luminance during a one frame period when the time division is not executed, and wherein whenever a time division into the first and second sub-frames is executed, gamma characteristics are the same as gamma characteristics during a one frame period when the time division is not executed.

12. The display device according to claim 10, wherein said parameters are set in such a manner that a luminance of output tonal data becomes as low as said low tonal data during the second sub-frame period.

13. The display device according to claim 10, wherein said input tonal data is either monochrome data or color data containing a plurality of color components;

wherein for the color data, said calculation circuit generates output tonal data during the first and second subframe periods for each of the color components.

14. The display device according to claim 10, further comprising:

a register configured to set parameters defining said plurality of bending points of the characteristics of said high tonal data, and to set parameters defining said plurality of bending points of the characteristics of said low tonal data, by utilizing a command from an external device.

* * * * *